United States Patent [19]

Smith

[11] 4,317,448

[45] Mar. 2, 1982

[54] SYRINGE-TYPE LIQUID CONTAINER DISPENSER ADAPTER

[75] Inventor: Philip E. Smith, Chicago, Ill.

[73] Assignee: Baxa Corporation, Northbrook, Ill.

[21] Appl. No.: 130,327

[22] Filed: Mar. 14, 1980

Related U.S. Application Data

[62] Division of Ser. No. 931,712, Aug. 8, 1978, Pat. No. 4,230,112.

[51] Int. Cl.[3] ..... A61J 1/00

[52] U.S. Cl. ..... 128/272.3

[58] Field of Search ..... 128/272.3, 272.1, 247, 128/218 R, 218 M, 215, 216, 214 R; 215/307, 355; 141/311 R, 363, 383, 392

[56] References Cited

U.S. PATENT DOCUMENTS

| | | | |
|---|---|---|---|
| 3,230,954 | 1/1966 | Burgess | 128/214 R |
| 3,552,387 | 1/1971 | Stevens | 128/272.1 |
| 4,153,057 | 5/1979 | Kobel | 128/272.1 |
| 4,210,142 | 7/1980 | Worder | 128/272.1 |

FOREIGN PATENT DOCUMENTS

| | | | |
|---|---|---|---|
| 2725476 | 12/1978 | Fed. Rep. of Germany | 128/272.3 |

*Primary Examiner*—John D. Yasko

*Attorney, Agent, or Firm*—Bernard L. Kleinke

[57] ABSTRACT

An adapter for connecting in fluid communication a liquid dispensing syringe with the interior of a bottle containing a liquid, such as a liquid medication, includes a tubular body member composed of resilient material and being generally cylindrical in shape to fit snugly within the mouth of the bottle. Projections or beads are provided on the body member for engaging the inside surface of the bottle thereof in a continuous line of engagement therewith with a high pressure per unit area of engagement. An opening extends axially through the body member for receiving the nozzle of the syringe, and the opening includes a forward nozzle receiving portion and a rear portion. The axial length of the forward portion is substantially the same as the axial length of the nozzle so that the exit end of the nozzle terminates at the rear enlarged portion when the nozzle is inserted fully within the opening. A fluid pathway disposed at the rear portion of the opening for the adapter guides liquid to the forward nozzle receiving portion and prevents or minimizes the introduction of air into the attachment opening. In one form of the invention, the fluid pathway is in the form of an enlarged portion of the opening to prevent air from entering the syringe when the bottle is inverted to fill the syringe. In another form of the invention, the fluid pathway includes a one-way valve to minimize introduction of air while enabling liquid to be drawn into the adapter opening without the necessity of inverting the bottle.

6 Claims, 7 Drawing Figures

FIG. 1
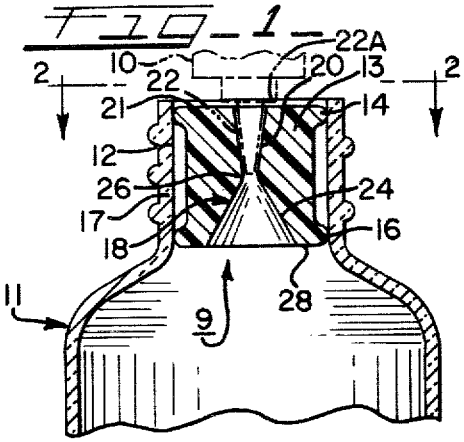
FIG. 3
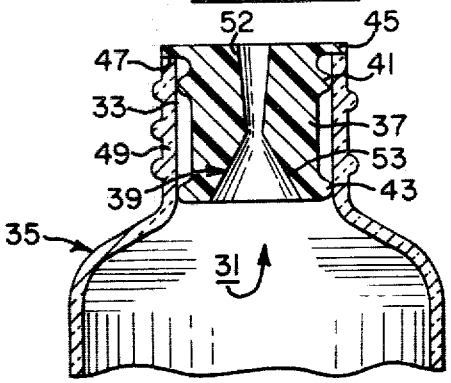
FIG. 2
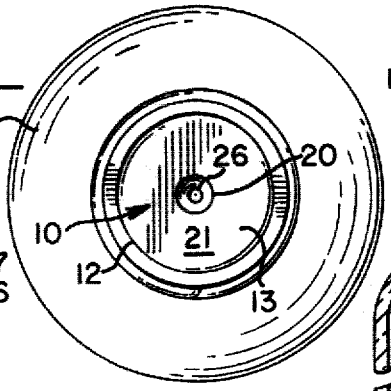
FIG. 5
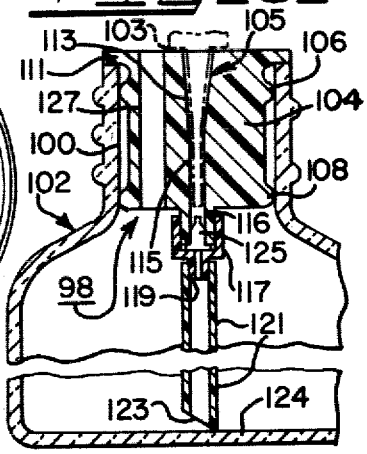
FIG. 6
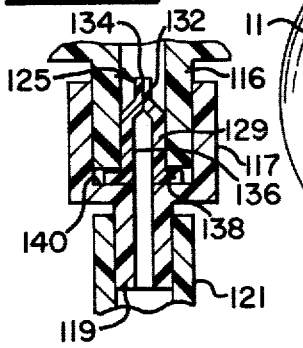
FIG. 7
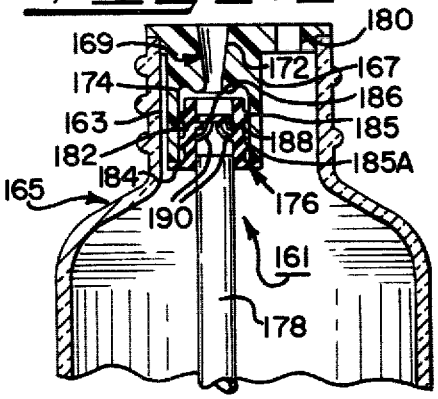
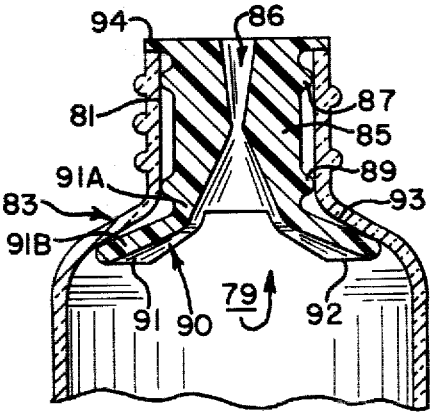
FIG. 4

SYRINGE-TYPE LIQUID CONTAINER DISPENSER ADAPTER

This is a division of application Ser. No. 931,712, filed Aug. 8, 1978, now U.S. Pat. No. 4,230,112.

BRIEF SUMMARY OF THE INVENTION

The present invention relates in general to a syringe-type liquid dispenser container adapter, and it more particularly relates to such an adapter which fits into the mouth of a bottle or the like container, such as a bottle containing liquid medication, and connects in fluid communication the interior of the bottle and a syringe-type oral medication dispenser for facilitating the filling thereof.

Liquid dispensing syringes can be used for different applications and have been employed for the purpose of measuring and orally administering liquid pediatric medications. Such oral syringes may be purchased under the name "PEE DEE DOSE" from Baxa Corporation located in Northbrook, Ill. Heretofore, the oral syringes have been used primarily by trained and professional personnel in hospitals for administering orally liquid medications to infants in an accurate and convenient manner. It would be highly desirable to enable untrained individuals to use the oral syringe at home for measuring and dispensing liquid medication from conventional glass or plastic medication bottles. However, for such use, it is important that such bottles or the like containers be provided with tamper-proof closures. Additionally, an adapter is necessary to attach to the bottle for enabling the nozzle of the syringe to be connected in fluid communication with the interior of the bottle to eliminate the need for pouring the medication and to prevent or minimize the spilling thereof. Such an adapter should be suitable for use with conventional medication bottles or the like containers employing tamper-proof closures. Such an adapter should be convenient to attach to the bottle, once it is filled with the liquid medication. In use, the attachment must be convenient to use in that the user should be able to insert and subsequently to withdraw the nozzle of the oral syringe into and out of the adapter without dislodging it from the container. Also, while an oral syringe is acknowledged widely to be the most accurate device available for administering pediatric liquid medication, the accuracy of the oral syringe is somewhat impaired in direct proportion to the amount of air introduced inadvertently into the syringe during the filling of same. Therefore, an accurate dosage is especially important for pediatric medication. The adapter should eliminate or at least greatly minimize the introduction of air into the syringe, because bubbles may otherwise be formed and an accurate reading of the quantity of medication contained in the graduated syringe would be impossible or at least very difficult. Air drawn into the oral dispenser syringe can cause an inaccurate reading of the dosage. Also, such an adapter should retain little or no residual medication therein, such as by capillary attraction, because the residual medication can dry and thus clog the opening in the adapter, thereby necessitating the time-consuming removal of the clogged unit and replacing it with another similar adapter.

Therefore, it is the principal object of the present invention to provide a new and improved liquid dispenser container adapter which can receive the nozzle of a dispenser for filling thereof with liquid from a container, such as a medication bottle, while greatly minimizing the possibility of the adapter being dislodged inadvertently from the container during filling of the dispenser.

Another object of the present invention is to provide such a new and improved liquid dispenser adapter, which can be made to fit under a conventional tamper-proof closure for the container and which retains little or no residual liquid when the adapter is not in use, while preventing or at least greatly minimizing the introduction of air into the dispenser during filling thereof.

Briefly, the above and further objects of the present invention are realized by providing a liquid dispenser adapter which includes a tubular body member composed of resilient material and being generally cylindrical in shape. The body member has an axially extending opening therein including a front nozzle receiving axially extending portion and a rear portion. The axial length of the forward portion is substantially the same as the axial length of the nozzle so that the exit end of the nozzle terminates at the rear portion when the nozzle is inserted fully within the front portion of the opening. The front portion is tapered to receive the complementary shaped nozzle of the syringe-type dispenser to provide a tight fit so that fluid does not tend to flow around the nozzle. A fluid pathway disposed at the rear portion of the opening for the adpater guides liquid to the forward nozzle receiving portion and prevents or minimizes the introduction of air into the attachment opening. In one form of the invention, the fluid pathway is in the form of an enlarged portion of the opening the prevent air from entering the syringe when the bottle is inverted to fill the syringe. In another form of the invention, the fluid pathway includes a one-way valve to minimize introduction of air while enabling liquid to be drawn into the adapter opening without the necessity of inverting the bottle. In certain embodiments of the present invention, projections or annular beads are disposed externally of the body member for engaging the inside surface of the bottle at the mouth thereof in a continuous line of engagement therewith with high pressure per unit area of engagement to attach securely the adapter to the bottle and to seal the adapter to the inside surface of the bottle.

Other objects and advantages of the present invention will become apparent to those skilled in the art by reference to the detailed description and accompanying drawings.

BRIEF DESCRIPTION OF THE DRAWINGS

FIG. 1 is a front elevational cross-sectional view of an adapter, which is constructed in accordance with the present invention and which is shown positioned in the mouth of a medication bottle.

FIG. 2 is a plan view of the adapter of FIG. 1 of the drawings.

FIG. 3 is a front elevational cross-sectional view of another adapter, which is also constructed in accordance with the present invention and shown in a medication bottle.

FIG. 4 is an elevational cross-sectional view of a further adapter, which is also constructed in accordance with the present invention and which is shown disposed in the mouth of a medication bottle.

FIG. 5 is yet another elevational cross-sectional view of an adapter, which is constructed in accordance with the present invention and which is shown disposed in the mouth of a medication bottle.

FIG. 6 is a cross-sectional view of a one-way valve of the adapter of FIG. 5.

FIG. 7 is an elevational cross-sectional view of still a further adapter, which is constructed in accordance with the present invention and which is shown disposed in a medication bottle.

DETAILED DESCRIPTION

Referring now to the drawings and more particularly to FIGS. 1 and 2 thereof, there is shown a liquid container dispenser adapter 9 which is constructed in accordance with the present invention and which enables a dispenser, such as a medication measuring and dispensing oral syringe shown partially in broken lines at 10 to be connected in fluid communication with the interior of a medication bottle 11 through the mouth 12 thereof.

It will become apparent to those skilled in the art that while the adapters shown and described herein are used in connection with a medical oral syringe for administering oral medication, the adapters of the present invention may also be used with syringes or the like dispensers for measuring and dispensing many different types and kinds of liquids.

The adapter 9 generally comprises a body portion 13 formed of resilient material, such as a suitable plastic material, and having a forwardly disposed external annular bead or projection 14 and a rearwardly disposed external annular bead or projection 16 for engaging sealingly the internal surface of the bottle neck 17 near the mouth 12. The beads engage the inside surface of the bottle 11 in a continuous annular line of engagement therewith with high pressure per unit area of engagement. In this manner, the adapter 9 remains securely in place when the syringe 10 is inserted into and subsequently withdrawn therefrom.

A centrally-disposed axially extending opening or hole generally indicated at 18 extends entirely through the body portion 13. The opening 18 includes a tapered forwardly disposed portion 20 which is adapted to receive completely a complementary-shaped nozzle 22 of the medication dispensing oral syringe 10 as indicated in broken lines in FIG. 1 of the drawing. In order to serve as a fluid pathway to prevent or at least to greatly minimize air from entering the syringe, a rear enlarged portion 24 of the opening 18 is conically shaped and extends from the smaller innermost portion 26 of the forward portion 20 of the opening 18 to a flat rear end annular face 28 disposed within the neck 17 of the bottle 11.

In use, the adapter 9 is inserted into the mouth 12 of the bottle 11 until its front annular face 21 is disposed within the forward portion of the mouth 12 within the neck 17 of the bottle 11. It should be noted that, when the adapter 9 is disposed in the position shown in FIG. 1 of the drawings, the bottle cap or closure (not shown) may be tightened back onto the medication bottle 11 in a conventional manner without being affected by the adapter 9 in any manner, and the adapter 9 does not interfere with the operation or function of the cap. In this regard, a tamper-proof bottle cap of a conventional design may be used in connection with the medication bottle 11, and such a cap does not interfere with the adapter.

In order to use the adapter 9 in connection with the medication dispensing oral syringe 10, a bottle cap (not shown) is removed from the bottle 11 to expose the adapter 9. The nozzle 22 of the syringe 10 is then inserted into the forward portion 20 of the opening 18. In this regard, the nozzle 22 is complementary shaped relative to the forward opening 20 and thus slides therein in a tight frictional sealing engagement. Also, as a result of the tapered shape of the forward portion 20 of the opening 18, the proper aligning of the nozzle 22 with the forward opening portion 20 is greatly facilitated. The nozzle 22 is inserted axially inwardly until its annular external shoulder 22A engages the front face 21. As a result, the bottle 11 is then inverted so that the liquid medication contained therein flows downwardly under the force of gravity into the rear conically-shaped portion 24 of the opening 18 and into the nozzle 22. In this position, the syringe 10 may be operated in a conventional manner to withdraw liquid medication from the interior of the bottle 11 to the interior of the syringe 10. Thereafter, the nozzle 22 of the syringe 10 is pulled out of the forward opening portion 20. The bottle 11 may then be sealed by the closure or cap (not shown) to preserve the freshness of the liquid medication contained in the bottle 11.

Considering now the body portion 13 in greater detail, the body portion 13 may be composed of suitable resilient material, such as a suitable plastic material. The external annular beads 14 and 16 provide continuous lines of engagement with the interior surface of the bottle neck 17 to provide a high pressure per unit area engagement with the interior surface thereof to prevent leakage of the liquid medication from the bottle 11 when it is disposed in its upside-down position during withdrawal of the liquid medication from the bottle 11. Furthermore, it facilitates the maintaining of the adapter 9 in position when the nozzle 22 is inserted into and subsequently withdrawn from the forward portion 20 of the opening 18 so that the adapter 9 is not pushed axially inwardly into the interior of the bottle 11 or pulled axially outwardly from therefrom.

The conically-shaped portion 24 of the opening 18 enables liquid medication to flow into contact with the end portion of the nozzle 22 so as to minimize the possibility of a bubble of air being drawn into the nozzle 22. In this regard, if the opening portion 24 were not enlarged but instead merely an extension or continuation of the narrowmost portion 17 of the foward portion 20 of the opening 18, a bubble could well form by capillary attraction therewithin and thus such an air bubble would enter the nozzle 22 and thus the syringe 10 via the nozzle 22. Thus, in accordance with the present invention, by having an enlarged opening 24, the capillary attraction is minimized and the possibility of air entering the nozzle 22 and thus preventing a more accurate reading on the syringe is prevented or at least greatly minimized.

The axial length of the forward portion 52 of the opening is substantially the same as the axial length of the nozzle 22 so that the exit end of the nozzle terminates at the entrance to the rear enlarged portion when the nozzle is inserted fully within the forward portion of the opening.

Due to the general hour-glass configuration of the opening 18, little or no residual liquid medication can become trapped therein, and therefore the opening does not tend to become clogged with dried residual medication. Also, since the adapter of the present invention is securely attached to the bottle, the adapter cannot be easily removed therefrom and transferred to another medication bottle so that residual medication cannot readily be transferred inadvertently to another medication bottle, thereby preventing or at least greatly minimizing the possibility of the unwanted mixing of two different medications.

Also, due to the shape of the enlarged rear portion 24 of the opening 18, there is sufficient material in the body portion 13 to provide suitable tension for the annular bead 16.

It should be noted that when the adapter 9 is inserted in position in the bottle 11, no portion thereof extends out of the bottle and thus it is very difficult to remove the adapter and transfer it to another medication container, thereby minimizing the problem of inadvertently mixing two different medications.

Referring now to FIG. 3 of the drawings, there is shown an adapter 31, which is also constructed in accordance with the present invention and which is shown disposed within the mouth 33 of a liquid medication bottle 35. The adapter 31 is similar to the adapter 9, and includes a body portion 37 having an opening 39 extending axially therethrough similar to the opening 18 of the adapter 9. A pair of front and rear external annular beads or projections 41 and 43 serve a similar purpose as the corresponding beads 14 and 16 of the adapter 9. An annular flange 45 extends radially outwardly from the forward portion of the generally cylindrically-shaped body portion 37 to engage and overlie the rim 47 surrounding the mouth 33 of the bottle 35 to provide additional help in preventing or at least greatly minimizing the possibility of the adapter 31 from moving axially inwardly toward the interior of the bottle 35 within the neck 49 thereof.

In this regard, in use when the nozzle (not shown) of a liquid medication dispensing oral syringe (not shown) is inserted into a forward end portion 52 of the opening 39, the flange 45 helps prevent the axial inwardly movement of the adapter 31 toward the interior of the bottle 31. Thus, the flange 45 secures the adapter 31 in place to a greater extent. It should be noted that the flange 45 does not extend beyond the neck 49 so that a tamperproof or regular cap or closure (not shown) for the bottle 31 may still be fastened onto the neck 49 over the mouth 33 without interfering with the adapter 31 which can then remain in position, and the adapter does not interfere with the closure.

In order to serve as a fluid pathway to prevent or at least greatly minimize air from entering the syringe, a rear end portion 53 of the opening 39 is conically shaped so as to receive the liquid medication when the bottle is inverted to fill a syringe (not shown). The rear portion 53 is similar to the rear portion 24 of the opening 18 of the adapter 9.

Referring now to FIG. 4 of the drawings, there is shown an adapter 79, which is also constructed in accordance with the present invention and which is illustrated in the mouth 81 of the bottle 83 containing liquid medication (not shown). Adapter 79 is similar to the adapter 31, but it includes both front and rear flanges, the front flange being similar to the front flange 45 of the adapter 31. Thus, where desired, the adapter 79 remains very firmly in position during both the insertion and withdrawal of the nozzle of the oral syringe.

The adapter 79 generally comprises a body portion 85, which is similar to the body portion 13 of the adapter 9. A general hour-glass shape opening 86 is centrally disposed and extends axially through the body portion 85 in a manner similar to the opening 18 of the adapter 9. A pair of external annular beads or projections 87 and 89 are similar and serve the same purpose as the annular beads 14 and 16 of the adapter 9.

A rearadownwardly flared flange 90 is generally conical in shape and comprises a plurality of resilient fingers 91 and 92 spaced apart by 180°. Each one of the resilient fingers, such as the finger 91, includes an upper downwardly depending upper portion 91A terminating in an outwardly flared lower portion 91B. In this manner, in order to insert the adapter 79 into the bottle 83, the rear flange 90 is first deformed inwardly to enable it to pass through the mouth 81 of the bottle 83. Thus, the adapter 79 can be inserted into the bottle until the rear flange 90 is moved passed the internal shoulder 93. At this position, the resilient fingers 91 and 92 of the rear flange 90 are permitted to snap outwardly into their unstressed state as shown in FIG. 4 of the drawings. In the unstressed state, the rear flange 90 is disposed in engagement with the internal shoulders 93 of the bottle 83. The fingers 91 and 92 are sufficiently wide to enable them to grip the inner surface of the bottle 83. As a result, when the nozzle, such as the nozzle 22 of the syringe 10, is pulled from the opening 86, the flange 90 helps retain the adapter 79 in position. Thus, adapter 79 does not move axially outwardly to any great extent.

Referring now to FIGS. 5 and 6 of the drawings, there is shown an adapter 98, which is constructed in accordance with the present invention and which is shown disposed within a mouth 100 of a bottle 102. The adapter 98 is similar to the adapter 31 except that the adapter 98 is designed to be used in connection with larger liquid medication bottles in such a manner that the bottle need not be inverted when an oral syringe, such as the syringe 103 is used to withdraw the liquid medication from the interior of the bottle and into the syringe.

The adapter 98 generally comprises a body portion 104, which is similar to the body portion 37 of the adapter 31. An opening or hole is centrally disposed and extends axially through the body portion 104 in a manner similar to the opening 39 of the adapter 31. A pair of front and rear external annular beads or projections 106 and 108, respectively, are similar to and serve the same purposes as the corresponding annular beads 41 and 43 of the adapter 31. A front flange 111 on the body portion 104 is similar to and serves the same purpose as the front flange 45 of the body portion 37 of the adapter 31.

Considering now the opening 105 in greater detail, the opening 105 includes a tapered forward portion 113, which is similar to the tapered forward portion 52 of the opening 39 of the adapter 31, the forward portion 113 serving the same purpose as the portion 52 of the adapter 51. A rear portion 115 of the opening 105 extends axially from the narrowmost portion of the forward portion 113 and extends at a constant cross-sectional area to a rearwardly projecting centrally-disposed nipple 116. A coupling 117 is sealably fixed to the nipple 116 and extends therefrom and terminates in a reduced diameter portion 119, which, in turn, is fixed sealingly to the upper end of a tube 121. The tube 121 includes a lower pointed end portion 123 resting at the bottom wall 124 of the bottle 102 to enable the liquid medication to be drawn from the interior of the bottle into a syringe inserted into the opening 105, the pointed end portion 123 facilitating the removal of all but a very small residue of the liquid medication from the interior of the bottle 102.

For the purpose of serving as a fluid pathway to prevent or at least greatly limit the introduction of air into the syringe, a one-way valve 125 is disposed within the nipple 116 and the coupling 117 as hereinafter described in greater detail. An air vent and re-entry hole 127 extends axially through the body portion 104 in a parallel-spaced apart manner relative to the central opening 105 for a hereinafter described purpose.

In use, after the adapter 98 is inserted into the mouth 100 of the bottle 102, as shown in FIG. 5 of the drawings, a cap or other closure (not shown) may be secured in place over the mouth 100 of the bottle 102 in a conventional manner without interfering with the adapter 98 in position and the adapter will not interfere with the normal function and operation of the closure, which may be a taper-proof closure. In order to fill a syringe, such as the syringe 10, the tap or closure is removed from the bottle 102 and the nozzle of the syringe is inserted into the forward portion 115 of the opening 105 in a manner similar to the manner which the syringe 10 cooperates with the adapter 9. The syringe is then used to draw liquid medication from the interior of the bottle 102 up through the tube 121, the connector 117, the one-way valve 125, the nipple 116, and into the opening 105 until the liquid enters the syringe under the force of the vacuum created by the syringe. During the first draw, air is withdrawn with the liquid into the syringe, because air is ordinarily present within the opening 105 and the tube 121. Therefore, the initial draw of liquid is then injected back into the interior of the bottle 102 by inserting the nozzle into the re-entry hole 127 and discharged back into the interior of the bottle 102.

Considering now the one-way valve described in greater detail, with reference to FIG. 6 of the drawings, the one-way valve 127 is a duckbill valve and includes a body portion 129 which is tubular in shape and hollow throughout most of its length. At its upper front end, there is a reduced diameter portion 132 which has a slit opening 134 communicating with the centrally disposed circular opening 136 extending throughout the entire length of the body portion 129. An annular flange 138 is disposed at its rear end portion and fits against the rear edge of the nipple 116 and is held in place by the inner shoulder 140 of the connector 117, which is sealably fixed to the nipple 116.

Thus, in use, during the initial draw of the liquid from the bottle, the liquid flows upwardly through the tubular body portion 129 and out the slit 134. Upon termination of the initial draw, the passage is closed off by the one-way valve to trap liquid in the tube 121 up to the valve, since air pressure cannot force the liquid back down the tube. Liquid cannot flow downwardly through the slit opening 134 in a reverse downward direction. Thus, when the nozzle of the syringe is inserted a second time into the opening 105 of the adapter 98, the liquid medication then flows into the syringe without air being trapped therein.

Referring now to FIG. 7 of the drawings, there is shown an adapter 161, which is also constructed in accordance with the principles of the present invention and which is similar to the adapter 98. The adapter 161 is disposed in a mouth 163 of a liquid medication bottle 165. The adapter 161 enables liquid medication (not shown) to be withdrawn from the interior of the bottle 165 into an oral syringe (not shown), such as the syringe 10 of FIG. 1 without the necessity for inverting the bottle 165 and preventing or at least greatly minimizing the introduction of air into the interior of the oral syringe.

The adapter 161 includes a body portion 167 having an axially extending opening 169, which includes a forward tapered portion 172, similar to the forward portion 20 of the adapter 9 of FIG. 1, and a rear enlarged portion 174. A one-way valve device 176 is disposed at the enlarged portion 174 of the opening 169 for the purpose of providing a fluid passage to prevent or at least greatly minimize the introduction of air into the liquid flowing into the oral syringe to be filled. A tube 178 is connected in fluid communication at its upper end to the one-way valve device 176 to withdraw the liquid medication from the interior of the bottle 165 in a similar manner as the tube 121 of the adapter 98 of FIG. 5.

Considering now the valve device 176 in greater detail, the valve device 176 is a molded unitary one-piece device which is composed of suitable resilient plastic material. The device 176 generally comprises a tubular valve body 182 having a rear annular external flange 184 and a pair of annular external beads or projections 185 and 185A to enable the valve body 182 to fit snugly and sealably within the enlarged portion 174 of the opening 169.

A valve member 186 is disposed within the interior of the valve body 182 and is disposed in the path of travel of the fluid flowing therethrough. An annular valve seat 188 is integrally connected to and extends from the inside surface of the valve body 182 and cooperates with the valve member 186 disposed downstream from the valve seat 188. A series of three valve stems 190 are integrally connected downstream to the rear face of the valve member 186 and are connected upstream in an integral manner to the inside surface of the valve body 182, the valve stems extending through the hole in the annular valve seat 188. The valve stems 190 are equally spaced apart, and only two of them are illustrated in the drawings.

The upper end of the tube 178 is press-fitted into the rear end portion of the valve body 182 at the annular flange 184.

The embodiments of the invention in which an exclusive property or privilege is claimed are defined as follows:

1. An adapter for connecting in fluid communication a nozzle of a liquid medication dispensing syringe with the interior of a bottle containing liquid medication, comprising:

a tubular body member composed of resilient material and being generally cylindrical in shape to fit snugly within the mouth of the bottle;

means defining an opening extending axially through said body member for receiving the nozzle of the syringe, said opening being generally of an hourglass configuration and including a forward nozzle receiving portion and a rear portion, the axial length of said forward portion being substantially the same as the axial length of the nozzle so that the exit end of the nozzle terminates at said rear portion when the nozzle is inserted fully within said opening, said forward portion being generally conical in shape throughout its axial length and having generally the same axial length as the axial length of said rear portion; and means defining a fluid pathway disposed at said rear portion of said opening for guiding liquid to said forward nozzle receiving portion and for preventing or minimizing the introduction of air into said opening;

wherein said rear portion of said opening is conically shaped and is substantially larger in size than said forward portion.

2. An adapter according to claim 1, further including projection means disposed externally of said body member for engaging the inside surface of the bottle at the mouth thereof in a continuous line of engagement therewith with high pressure per unit area of engagement.

3. An adapter according to claim 2, wherein said forward portion of said opening is tapered inwardly to said rear portion of said opening.

4. An adapter according to claim 3, further including a front annular flange for engaging the bottle to help resist moving axially said adapter into the bottle.

5. An adapter according to claim 3, further including a rear annular flange, said flange having a plurality of spaced-apart resilient fingers.

6. An adapter according to claim 1, further including a rear annular flange, said flange having a plurality of spaced-apart resilient fingers.

* * * * *